United States Patent [19]

Bassa

[11] Patent Number: 4,545,321

[45] Date of Patent: Oct. 8, 1985

[54] VACUUM BOX WITH VARIABLE STAGE VOLUME TO IMPROVE COATING UNIFORMITY

[75] Inventor: Altan Bassa, Dreieich-Sprendlingen, Fed. Rep. of Germany

[73] Assignee: E. I. Du Pont de Nemours and Company, Wilmington, Del.

[21] Appl. No.: 590,512

[22] Filed: Mar. 16, 1984

[30] Foreign Application Priority Data

Mar. 16, 1983 [DE] Fed. Rep. of Germany ..... 3309343

[51] Int. Cl.[4] ..... C23C 13/08; B05C 3/02

[52] U.S. Cl. ..... 118/50; 118/410

[58] Field of Search ..... 118/50, 65, 410, 411, 118/412

[56] References Cited

U.S. PATENT DOCUMENTS 3,503,370 3/1970 Ishiwata et al. ..... 118/50

4,335,672 6/1982 Krussig ..... 118/50

*Primary Examiner*—Norman Morgenstern

*Assistant Examiner*—Kenneth Jaconetty

[57] ABSTRACT

A device for the application of at least one cast layer (7) on a moving sheet-shaped substrate (4) has a rotating casting roll (1) which guides the substrate. A pouring vessel (8) is arranged adjacent to the casting roll while leaving a casting gap (13). A suction device with a housing (15) has a low pressure chamber (16) extending from the gap (13) to a partition (25) and has a vacuum chamber (17) extending from the partition (25) to an end wall (26). Partition (25) and/or end wall (26) can be adjusted in circumferential direction. The low pressure chamber (16) and the vacuum chamber (17) are connected with each other by means of a bypass (51). In this way, even under varying operating conditions, a high constancy of the pressure in the low pressure chamber (16) can be attained.

13 Claims, 3 Drawing Figures

VACUUM BOX WITH VARIABLE STAGE VOLUME TO IMPROVE COATING UNIFORMITY

BACKGROUND OF THE INVENTION

1. Technical Field

This invention relates to casting one or more layers of a film-forming liquid on a substrate, and to the apparatus employed for that purpose.

2. State of the Art

The prior art is replete with means for casting a film-forming liquid upon a moving substrate. In a known coating device of this type, (U.S. Pat. No. 4,335,672), a suction device is provided with fixed walls, a low pressure chamber, and a vacuum chamber, having a given set volume. The two chambers are connected with each other via the gap between the suction device and the substrate. Low pressure in the low pressure chamber stabilizes the bead which is formed in the casting gap by the casting material. Since the low pressure chamber is surrounded on three sides by the vacuum chamber, the disturbances produced by the incoming air from the environment are extensively avoided. As a result, the bead is guaranteed not to be subjected to any disturbances from air turbulence or pressure fluctuations so that a uniform application of the cast layer is obtained. Periodic disturbances of the cast layer are at times observed, however, based on pressure fluctuations in the low pressure chamber. Certain problems exist, moreover, when changes in the operating conditions (different sheet speed, a different thickness of the substrate, etc), requires reestablishing the optimum relationships, even when the suction device is radially adjusted to change the gap between the suction device and the substrate.

The object of the present invention is to provide a device of the above described type which permits further reductions in pressure fluctuations and turbulence in the low pressure chamber when the operating conditions are varied. In a first embodiment of the invention this objective is met by adjusting the partition and/or the end wall in circumferential direction.

According to a second embodiment of the invention which can be used simultaneously with the first embodiment, this objective is met by connecting the low pressure chamber and the vacuum chamber by means of a bypass.

SUMMARY OF THE INVENTION

The invention relates to a device for the application of at least one cast layer on a moving sheet-shaped substrate, said device comprising a rotating casting roll which guides the substrate, a pouring vessel having at least one discharge slot for liquid coating composition which vessel is arranged adjacent to the casting roll while leaving a casting gap in between, and a suction device adjacent to the casting roll and the pouring vessel, said device having (1) a low pressure chamber in a housing extending in circumferential direction from the gap to a partition, and (2) a vacuum chamber extending from the partition to an end wall provided, in particular, with extensions running along the front sides of the low pressure chamber.

BRIEF DESCRIPTION OF THE DRAWINGS

The invention is illustrated in more detail in the drawings.

Referring to FIG. 1, a casting roll 1 rotates around an axle 2 in the direction of arrow 3. A sheet-shaped substrate 4 is guided on casting roll 1. An extrusion coating device indicated by reference connection 5 serves to transfer a laminar liquid layer 6 to substrate 4, on which a cast layer 7 develops as a film which is much less thick than liquid layer 6 since the forwarding speed of substrate 4 is considerably higher than the flow speed of liquid layer 6, for example 10 times higher.

Figure 1:
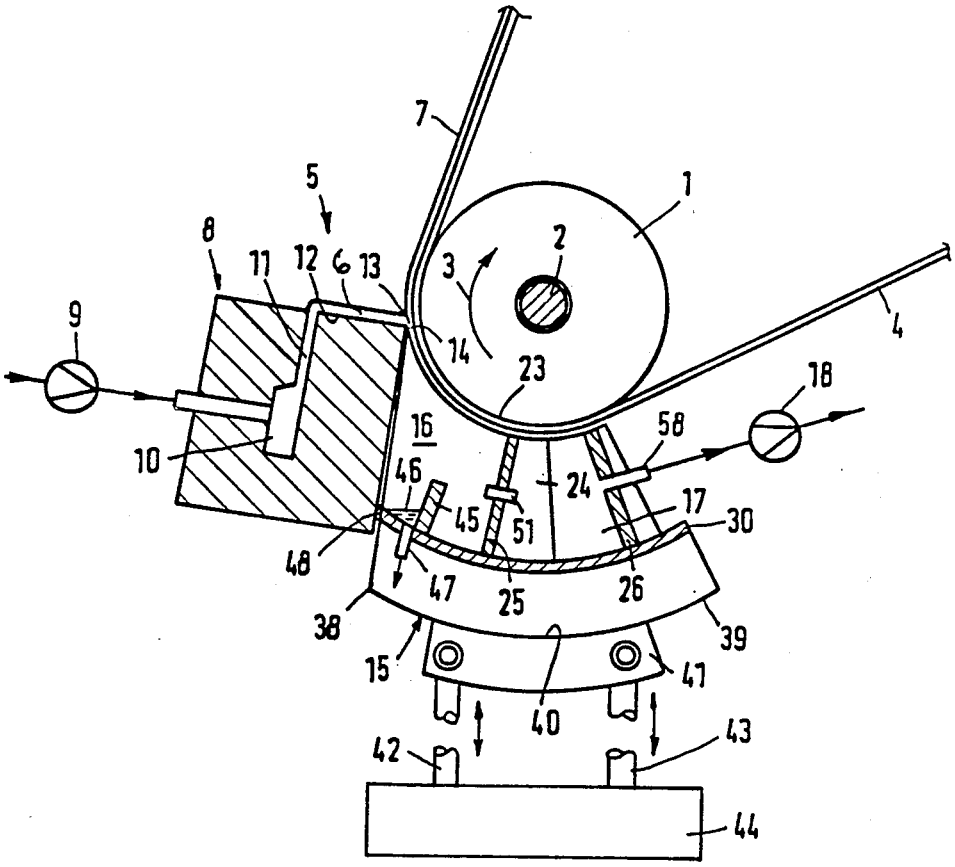
FIG. 1 is a schematic illustration of an extrusion coating device according to the invention, partially in cross section.

Liquid coating composition, i.e., casting material, is supplied by means of a pump 9 to a pouring vessel 8 which can be heated. The liquid arrives from a chamber 10 via a discharge slot 11 at a sloping face 12 on which it flows down as liquid layer 6. The pouring vessel 8 may have several chambers 10 with associated discharge slots 11 so that in a known manner several liquid layers 6 can be supplied over each other to substrate 4. In a specific embodiment the liquid is a light-sensitive emulsion so that the coated substrate 4 can be used as photographic recording material. A casting gap 13 is formed between the pouring vessel 8 and the substrate 4, which—to the extent not filled up by the substrate 4—is bridged by a bead 14 of liquid layer 6. Casting gap 13 can be changed by an adjustment of the pouring vessel 8 with a radial component. Pouring vessel 8 can also be adjusted to random other directions in order to take into account the many factors which must be observed in operation such as the substance properties of the emulsion and covering solutions, the layer thickness on the substrate, the range of the casting speed, etc.

Figure 3:
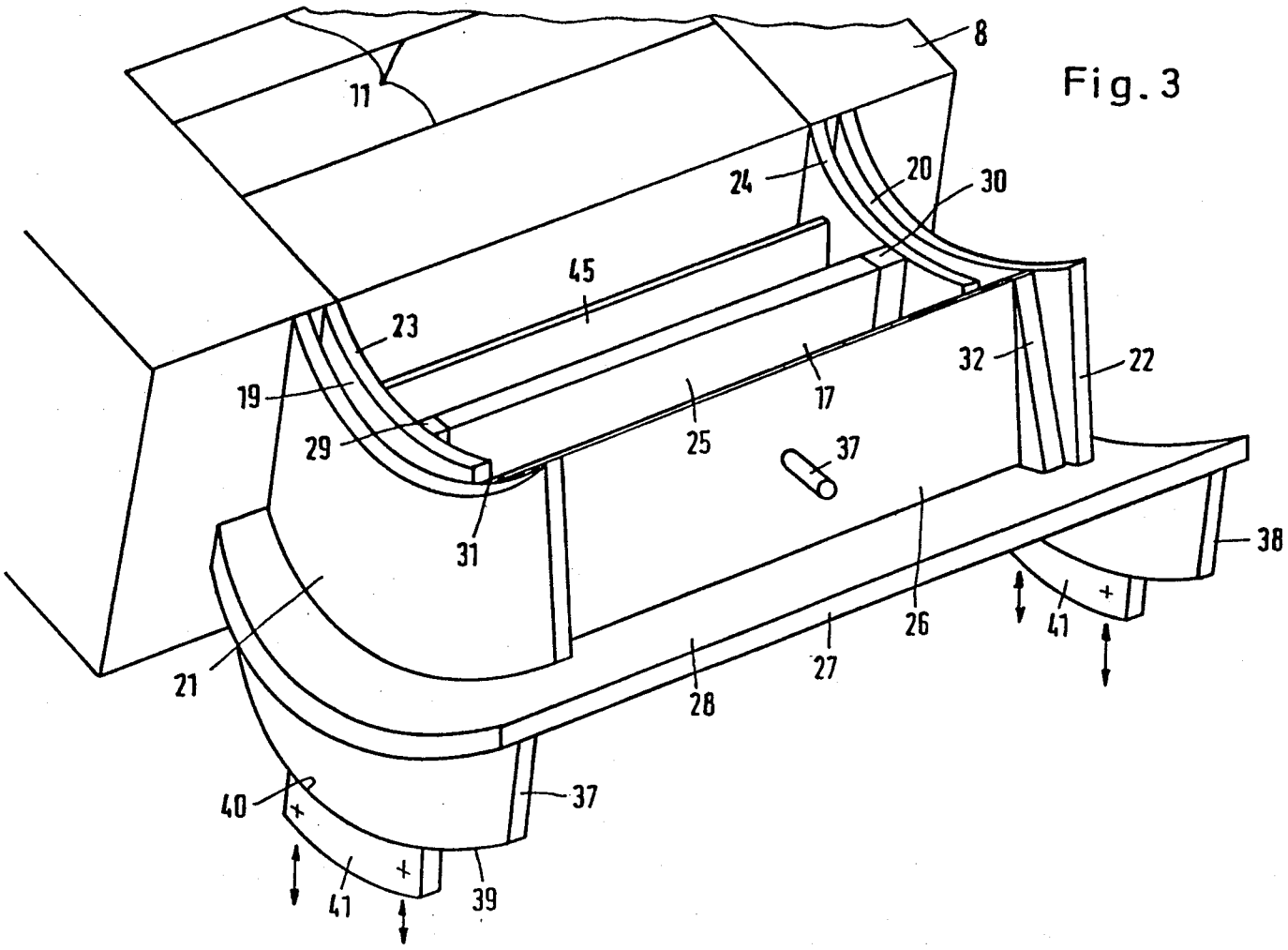
FIG. 3 is a plan view of the pouring vessel and suction device in perspective.

A suction device has a housing 15 with a low pressure chamber 16 and a vacuum chamber 17, which is connected to a blower 18, e.g., a vacuum pump. The stability of bead 14 is increased by the low pressure in the low pressure chamber 16 which extends, therefore, over the width of the layer 6. Vacuum chamber 17 has two extensions 19 and 20 (FIG. 3) which extends in a plane perpendicular to the axle 2 along both sides of the low pressure chamber 16 to the casting gap 13. The housing 15 has side walls 21 and 22 which form a gap, depending on the width of the substrate 4, with this substrate or with the casting roll 1 and the amount of air arriving from the atmosphere into the vacuum chamber 17 depends on the width of this gap. The housing 15, furthermore, has side walls 23 and 24 and a partition 25 extends between these walls. An end wall 26 runs between the side walls 21 and 22. Partition 25 and end wall 26 are adjustable in the circumferential direction of the casting roll 1.

The housing 15 of the suction device has as bottom a partially cylindrical dish 27 concentric to the casting roll 1 and the top of this dish forms a guide face 28 on which the partition 25 and the end wall 26 can be adjusted. The partition 25 consists of a plate provided on the sides with a circle segment 29 and 30. The end wall 26 consists of a plate provided on the sides with a circle segment 31 and 32. These circle segments rest each time against the side walls, i.e. 23 and 24 against 21 and 22, respectively. The under sides 33, 34 of the circle segments 29 to 32 provides a very secure guiding of the partition 25 and the end wall 26. Partition 25 and end wall 26 can be securely held in place by means of clamping devices 35 and 36, in particular, clamping screws.

Figure 2:
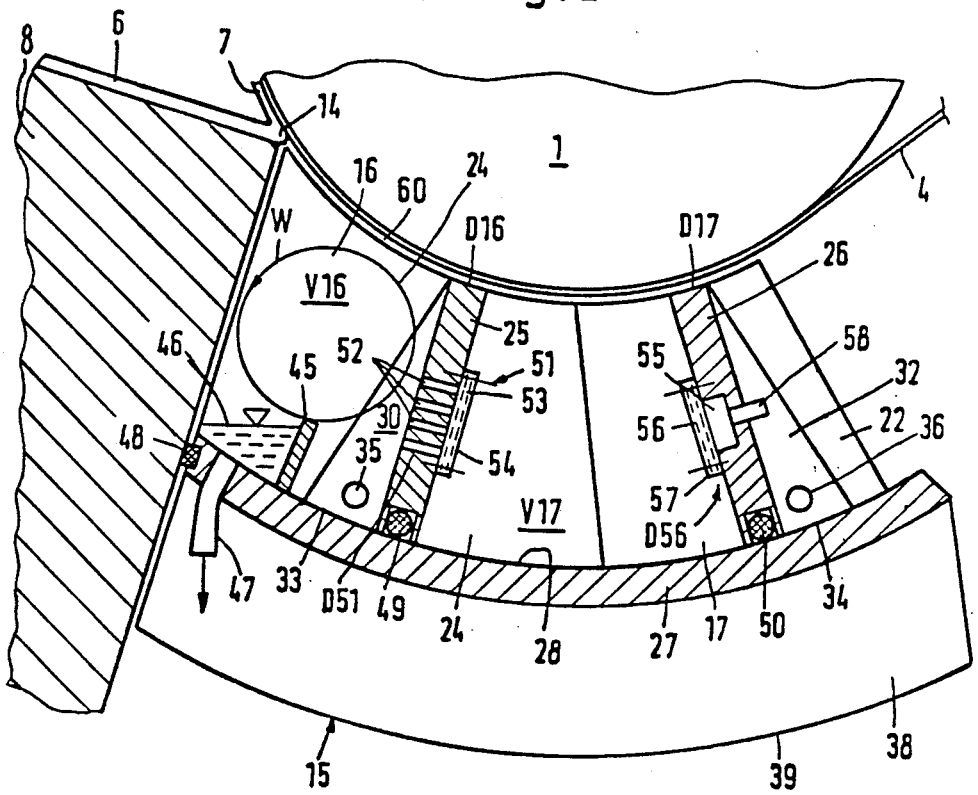
FIG. 2 is an enlarged illustration of a section of FIG. 1.

Furthermore, two carriers 37 and 38 which stiffen the partially cylindrical dish 27, with a cylindrical contact face 39, are part of the housing 15. This contact face rests on a partially cylindrical guide face 40 of a support 41. The latter can be adjusted in height by means of actuating rods 42 and 43 in relation to a fixed frame base 44 and in relation to casting roll 1 in order to adjust in this way the width of the gap 60 (seen in FIG. 2).

In the low pressure chamber 16, a weir 45 is positioned to form a collecting space 46 for coating material. A run-off opening 47 leads to the outside from this collecting space. In this way, the partition 25 can be pushed relatively far in the direction of the pouring vessel 8 without covering the run-off opening.

Between pouring vessel 8 and housing 15, a seal 48 is provided either as an elastic cord, an elastic sealing compound or as bellows. In this way, the pouring vessel 8 and the suction device can be adjusted independent of each other; the low pressure chamber 16 is, nevertheless, sealed towards the outside. The partition 25 has a seal 49. The end wall 26 has a seal 50.

In the partition 25, a bypass 51 is located, which bypass may consist of a cutout in the partition, of several slots and the like. According to FIG. 2, it has many small bores 52 which are distributed over part of the height and over the width of the partition 25. On the side of the vacuum chamber 17 the bores 52 are covered by a throttling filter layer 53 which is held in place by means of a changeable holder 54, for example, a removable frame. The filter layer can be exchanged accordingly when a different throttling action is desired.

In the end wall 26, a groove 55 extending over its width is provided which is also covered by a throttling filter layer 56 held in place by a changeable holder 57, for example, a removable frame. On the opposite side, a suction line 58 is provided which is connected to the vacuum pump 18. The filters can be changed to adapt to new operating conditions.

The volume V16 of the low pressure chamber 16, the volume V17 of the vacuum chamber 17, the throttle D16 formed in the gap 60 around the low pressure chamber 16 and the parallel-arranged throttle D51 formed by the bypass 51 together with the entry throttle D17 provided by the gap 60 and the exit throttle D56 provided by the throttling filter layer 56 form a pneumatic system with certain vibration properties which can be affected by adjusting the partition 25 or the end wall 26. As a result, a setting can be obtained in which all possible exciter frequencies can be dampened. These exciter frequencies include, for example, the vibrations produced by the vacuum pump 18, the vibrations produced by the imbalance of the casting roll 1, and the vibrations produced by thickness and width fluctuations of the substrate 4.

The higher the sheet speed, the greater the amount of air entrained, i.e., dragged along in the boundary layer of the substrate 4, which air collects in the low pressure chamber 16 and must be evacuated. The greater the amount of thus supplied air, the greater the rotation energy of the air roll W (see FIG. 2) in the low pressure chamber. The air roll and its energy can be affected by adjusting the partition 25 and, therefore, the shape of the low pressure chamber 16 or by air evacuation via the bypass 51 in such a way that the disturbances at the bead 14 caused by the air roll are held to a minimum. Higher sheet speeds, however, also lead to turbulence behind the gap defined by the partition 25 and, therefore, to disturbances near the bead 14. By adjusting the partition 25, their disturbing effect is reduced by increasing the volume of the low pressure chamber 16 and of the distance of turbulence from the bead. By using the bypass, the air does not have to be exclusively evacuated via the gap 60 surrounding the low pressure chamber. This gap can be kept smaller so that the turbulence is also less.

By using the bypass 51, the actual width of the gap 60 plays a less aggravating role than before since in any case an adequate evacuation takes place via the bypass 51. When the substrate 4 is changed, it is, therefore, not necessary to make a new adjustment in the width of the gap 60. By using the bypass the radial adjustment of the suction means can be dispensed with, even when there has been a change in the casting speed or in the substrate thickness.

In summary, the low pressure chamber, the vacuum chamber, and the throttling positions located in between form a pneumatic vibration system. Resonance frequency can be affected by adjustment of the partition and/or the end wall, in other words, by adapting the volumes of low pressure chamber and/or vacuum chamber. The same applies for the parallel arrangement of a bypass to the connecting gap. In this way, pressure fluctuations in the low pressure chamber produced by disturbances can be effectively dampened. Such disturbing frequencies are produced, for example, in the vacuum pump, by an eccentricity of the casting roll, or by periodic thickness (width) changes of the substrate.

I claim:

1. An apparatus for the application of at least one cast layer on a moving sheet-shaped substrate comprising, in combination, a rotating casting roll which guides the substrate, a pouring vessel having at least one discharge slot for liquid casting material, which vessel is positioned adjacent to the casting roll while leaving a casting gap, and a suction device adjacent the casting roll, which functions to draw off air entrained by the moving substrate, said suction device being in the form of a curved box wherein the top and bottom of the box each lies in a plane concentric to the casting roll, said box having a housing, a low pressure chamber and a vacuum chamber in said housing, and a partition between chambers, the low pressure chamber extending in circumferential direction from the gap to the partition, and the vacuum chamber extending from the partition to an end wall provided with extensions running along the front sides of the low pressure chamber, further characterized in that the partition (25) and/or the end wall (26) can be adjusted in circumferential direction.

2. An apparatus for the application of at least one cast layer on a moving sheet-shaped substrate comprising, in combination, a rotating casting roll which guides the substrate, a pouring vessel having at least one discharge slot for liquid casting material, which vessel is positioned adjacent to the casting roll while leaving a casting gap, and a suction device adjacent the casting roll, which functions to draw off air entrained by the moving substrate, said suction device being in the form of a curved box wherein the top and bottom of the box each lies in a plane concentric to the casting roll, said box having a housing, a low pressure chamber and a vacuum chamber in said housing, and a partition between chambers, the low pressure chamber extending in circumferential direction from the gap to the partition, and the vacuum chamber extending from the partition to an end wall provided with extensions running along the front sides of the low pressure chamber the low pressure chamber (16) and the vacuum chamber (17) are connected with each other via a bypass (51), further characterized in that the partition (25) and/or the end wall (26) can be adjusted in circumferential direction.

3. The apparatus of claim 1, characterized by a guide face (28) concentric to the casting roll (1) on which the partition (25) and/or the end wall (26) can be adjusted.

4. An apparatus for the application of at least one cast layer on a moving sheet-shaped substrate comprising, in combination, a rotating casting roll which guides the substrate, a pouring vessel having at least one discharge slot for liquid casting material, which vessel is positioned adjacent to the casting roll while leaving a casting gap, and a suction device adjacent the casting roll, which functions to draw off air entrained by the moving substrate, said suction device being in the form of a curved box wherein the top and bottom of the box each lies in a plane concentric to the casting roll, said box having a housing, a low pressure chamber and a vacuum chamber in said housing, and a partition between chambers, the low pressure chamber extending in circumferential direction from the gap to the partition, and the vacuum chamber extending from the partition to an end wall provided with extensions running along the front sides of the low pressure chamber, further characterized in that the partition (25) and/or the end wall (26) can be adjusted in circumferential direction and a guide face (28) concentric to the casting roll (1) on which the partition (25) and/or the end wall (26) can be adjusted and the bottom of the housing is a partially cylindrical disk (27) concentric to the casting roll (1) which forms the guide face (28).

5. The apparatus of claim 4, characterized in that the housing (15) per se is adjustable on a guide face (40) concentric to the casting roll (1).

6. The apparatus of claim 1, characterized in that the partition (25) and/or the end wall (26) rest with both front sides against a side wall (21 to 24) fixed on the housing.

7. An apparatus for the application of at least one cast layer on a moving sheet-shaped substrate comprising, in combination, a rotating casting roll which guides the substrate, a pouring vessel having at least one discharge slot for liquid casting material, which vessel is positioned adjacent to the casting roll while leaving a casting gap, and a suction device adjacent the casting roll, which functions to draw off air entrained by the moving substrate, said suction device being in the form of a curved box wherein the top and bottom of the box each lies in a plane concentric to the casting roll, said box having a housing, a low pressure chamber and a vacuum chamber in said housing, and a partition between chambers, the low pressure chamber extending in circumferential direction from the gap to the partition, and the vacuum chamber extending from the partition to an end wall provided with extensions running along the front sides of the low pressure chamber the partition (25) and/or the end wall (26) is formed by a plate provided on the front side with a circle segment (29 to 32) and rest with both front sides against a side wall (21 to 24) fixed on the housing, further characterized in that the partition (25) and/or the end wall (26) can be adjusted in circumferential direction.

8. The apparatus of claim 1 which further comprises clamping devices (35,36) securing the position of the partition (25) and/or the end wall (26).

9. An apparatus for the application of at least one cast layer on a moving sheet-shaped substrate comprising, in combination, a rotating casting roll which guides the substrate, a pouring vessel having at least one discharge slot for liquid casting material, which vessel is positioned adjacent to the casting roll while leaving a casting gap, and a suction device adjacent the casting roll, which functions to draw off air entrained by the moving substrate, said suction device being in the form of a curved box wherein the top and bottom of the box each lies in a plane concentric to the casting roll, said box having a housing, a low pressure chamber and a vacuum chamber in said housing, and a partition between chambers, the low pressure chamber extending in circumferential direction from the gap to the partition, and the vacuum chamber extending from the partition to an end wall provided with extensions running along the front sides of the low pressure chamber, further characterized in that the partition (25) and/or the end wall (26) can be adjusted in circumferential direction and having clamping devices (35, 36) securing the position of the partition (25) and/or the end wall (26) and screws penetrate through the circle segments (29 to 32) and are in clamped contact with the adjacent side walls (21 to 24).

10. The apparatus of claim 9, characterized in that the low pressure chamber (16) includes a weir (45) at the bottom which defines a collecting space (46) containing a run-off opening (47), provided on the side facing the gap (13).

11. The apparatus of claim 10, characterized in that the bypass line (51) has a cross section distributed over the length of the partition, which is covered by at least one throttling filter layer (53).

12. The apparatus of claim 11, characterized in that a suction line (58) starts from a longitudinal groove (55) provided on the side of the end wall (26) facing the vacuum chamber (17), which is covered by at least one throttling filter layer (56).

13. The apparatus of claim 12, characterized in that filter layers (53,56) are arranged in a changeable holder (54,57).

* * * * *